US010051952B2

(12) United States Patent
Aide

(10) Patent No.: US 10,051,952 B2
(45) Date of Patent: Aug. 21, 2018

(54) BRUSH HANGING SYSTEM

(71) Applicant: Richard E. Aide, Panama City, FL (US)

(72) Inventor: Richard E. Aide, Panama City, FL (US)

( * ) Notice: Subject to any disclaimer, the term of this patent is extended or adjusted under 35 U.S.C. 154(b) by 428 days.

(21) Appl. No.: 14/960,900

(22) Filed: Dec. 7, 2015

(65) Prior Publication Data

US 2017/0007012 A1 Jan. 12, 2017

Related U.S. Application Data

(60) Provisional application No. 62/188,874, filed on Jul. 6, 2015.

(51) Int. Cl.
*A46B 15/00* (2006.01)
*B44D 3/12* (2006.01)

(52) U.S. Cl.
CPC ..... *A46B 15/0055* (2013.01); *A46B 15/0095* (2013.01); *B44D 3/123* (2013.01)

(58) Field of Classification Search
CPC .. A46B 15/0095; A46B 15/0097; B44D 3/123
See application file for complete search history.

(56) References Cited

U.S. PATENT DOCUMENTS 888,896 A * 5/1908 Howard ..... A46B 17/02 248/685
1,206,010 A * 11/1916 Mackeever ..... A46B 17/02 248/685
1,215,052 A 2/1917 Nelson
1,228,774 A * 6/1917 Hecht ..... A46B 17/02 248/685
1,277,019 A 8/1918 Wright
1,312,178 A 8/1919 Hill
1,313,515 A 8/1919 Caffrey
1,328,162 A * 1/1920 Hecht ..... A46B 17/08 248/691
3,231,919 A 2/1966 MacDonald
3,612,464 A 10/1971 Harrah
3,935,956 A * 2/1976 Sansanelli ..... A61M 5/1417 215/399
5,044,038 A 9/1991 Matkovic
5,406,668 A 4/1995 Goodhue
6,314,604 B1 11/2001 Ahlstrom
7,658,352 B2 2/2010 Gronbach

* cited by examiner

*Primary Examiner* — Randall Chin
(74) *Attorney, Agent, or Firm* — Neustel Law Offices

(57) ABSTRACT

A brush hanging system for efficiently and safely hanging a brush from another object such as a paint can. The brush hanging system generally includes a brush such as a paint brush. The brush includes a groove formed within the body of the brush, such as on its handle or any other position other than its bristles. A hanger rod is pivotally connected within the groove, with the hanger rod being adapted to selectively engage or disengage with the rim of an object such as a paint can. When extended, the hanger rod engages with the rim to removably secure the brush against the object. When retracted, the hanger rod is completely positioned within the groove in a flush or recessed configuration. Both the groove and hanger rod each comprise distinct segments which ensure that the hanger rod may pivot within the groove and engage with the rim.

15 Claims, 9 Drawing Sheets

BRUSH HANGING SYSTEM

CROSS REFERENCE TO RELATED APPLICATIONS

I hereby claim benefit under Title 35, United States Code, Section 119(e) of U.S. provisional patent application Ser. No. 62/188,874 filed Jul. 6, 2015. The 62/188,874 application is hereby incorporated by reference into this application.

STATEMENT REGARDING FEDERALLY SPONSORED RESEARCH OR DEVELOPMENT

Not applicable to this application.

BACKGROUND OF THE INVENTION

Field of the Invention

The present invention relates generally to a recessed brush hangar and more specifically it relates to a brush hanging system for efficiently and safely hanging a brush from another object such as a paint can.

Description of the Related Art

Any discussion of the related art throughout the specification should in no way be considered as an admission that such related art is widely known or forms part of common general knowledge in the field.

Brushes have been in use for centuries. Paint brushes are commonly used for a wide range of applications, from artwork to housework. In most applications, a paint brush will have to be put down somewhere during the painting process. For example, multiple paint brushes are necessary for many jobs, with each paint brush having a different bristle configuration.

However, when switching between paint brushes, there is often not a good place to rest the used paint brush. Often an individual will use a separate container just to hold used brushes. This can be inefficient and can lead to undesirable mixing of paints. It would be much more preferable if each paint brush could be secured temporarily to its own paint can so that colors do not mix.

Because of the inherent problems with the related art, there is a need for a new and improved brush hanging system for efficiently and safely hanging a brush from another object such as a paint can.

BRIEF SUMMARY OF THE INVENTION

Provided herein is a brush holder which includes a brush such as a paint brush. The brush includes a groove formed within the body of the brush, such as on its handle or any other position other than its bristles. A hanger rod is pivotally connected within the groove, with the hanger rod being adapted to selectively engage or disengage with the rim of an object such as a paint can. When extended, the hanger rod engages with the rim to removably secure the brush against the object. When retracted, the hanger rod is completely positioned within the groove in a flush or recessed configuration. Both the groove and hanger rod each comprise distinct segments which ensure that the hanger rod may pivot within the groove and engage with the rim.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
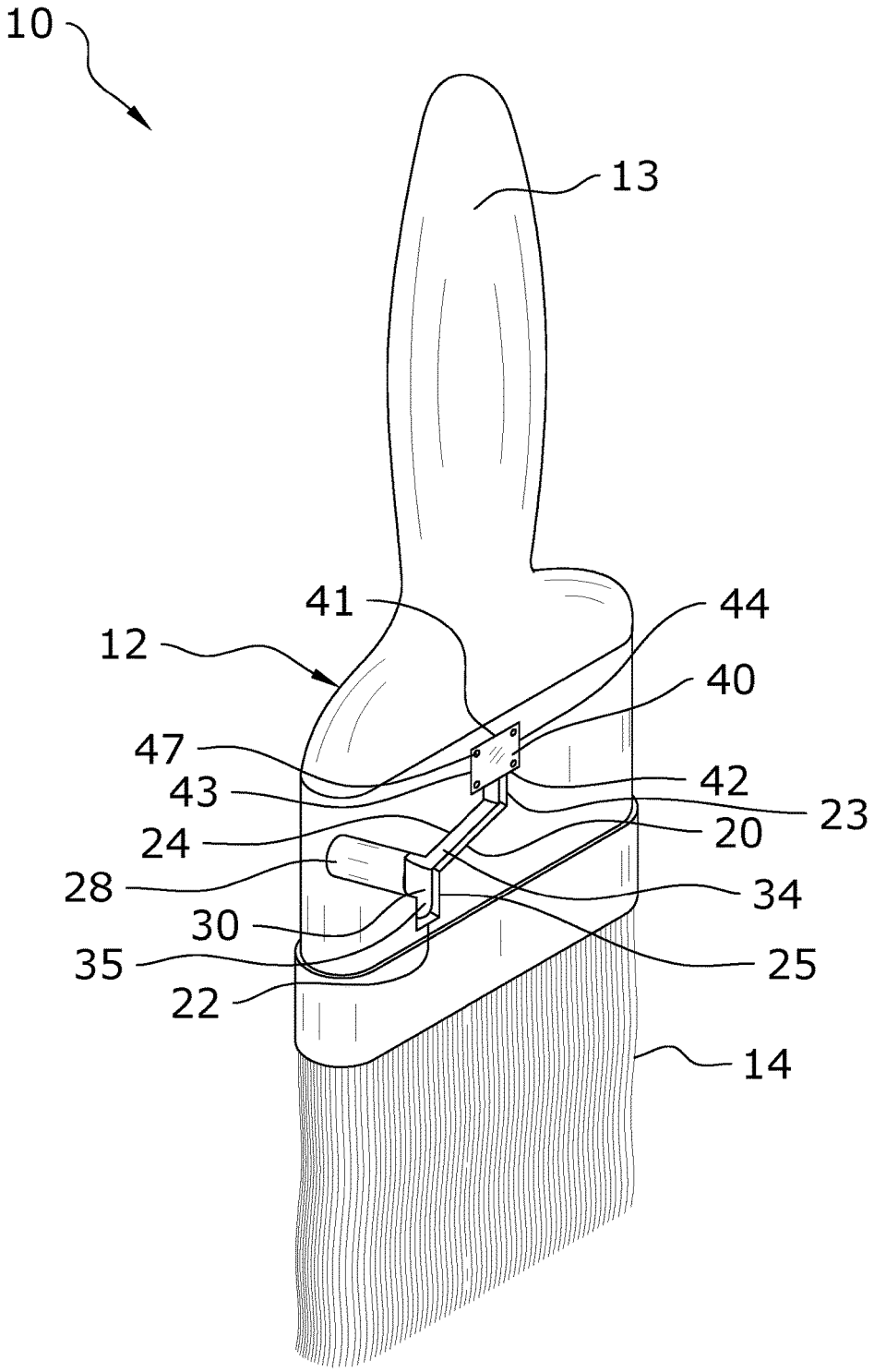
FIG. 1 is an upper perspective view of the present invention with the hanger in a retracted position.

Turning now descriptively to the drawings, in which similar reference characters denote similar elements throughout the several views, FIGS. 1 through 10 illustrate a brush hanging system 10, which comprises a brush 12 such as a paint brush. The brush 12 includes a groove 20 formed within the body of the brush 12, such as on its handle or any other position other than its bristles 14. A hanger rod 30 is pivotally connected within the groove 20, with the hanger rod 30 being adapted to selectively engage or disengage with the rim 17 of an object 16 such as a paint can. When extended, the hanger rod 30 engages with the rim 17 to removably secure the brush 12 against the object 16. When retracted, the hanger rod 30 is completely positioned within the groove 20 in a flush or recessed configuration. Both the groove 20 and hanger rod 30 each comprise distinct segments 23, 24, 25, 33, 34, 35 which ensure that the hanger rod 30 may pivot within the groove 20 and engage with the rim 17.

B. Brush and Can

As shown throughout the figures, the present invention is well-suited for use with a paint brush 12 and paint can 16. The present invention should not, however, be construed as limited for use in connection with paint tools. The present invention may be utilized for securing a wide range of brushes 12 to a wide range of objects 16 such as cans. Generally, the object 16 will include a rim 17 on which the hanger rod 30 of the present invention will be secured. The shape, size, and configuration of the brushes 12 and cans 16 may vary for different applications.

In the preferred embodiment shown in the figures, which is in no way limiting on the scope of the present invention, the brush 12 comprises a body 13 and a plurality of bristles 14 extending from the body. The body 13 of the brush 12 comprises any portion of the brush 12 which is not the bristles 14, including the handle. The groove 20 of the present invention, as discussed below, may be positioned at any location on the body 13 of the brush 12.

C. Groove

Figure 5:
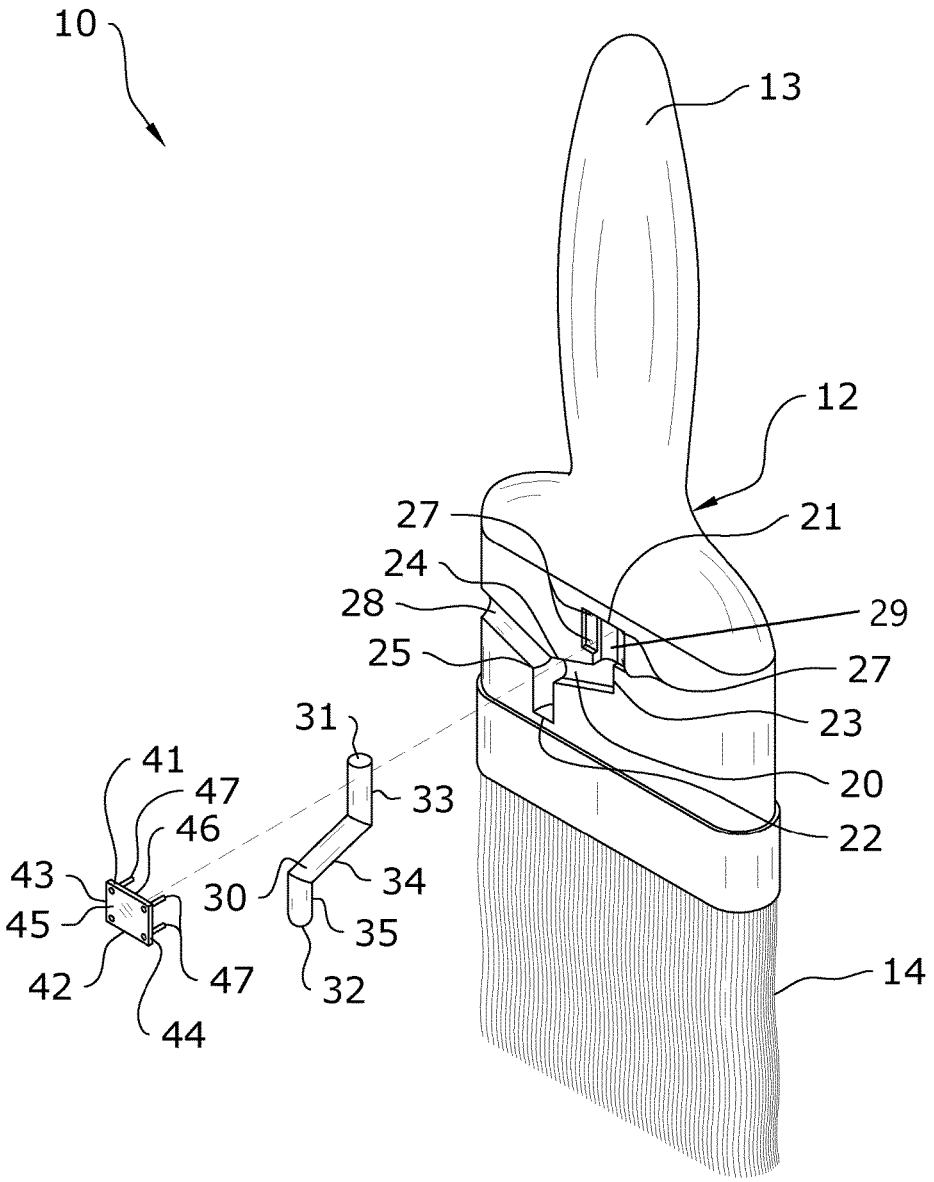
FIG. 5 is an exploded view of the present invention.
Figure 6:
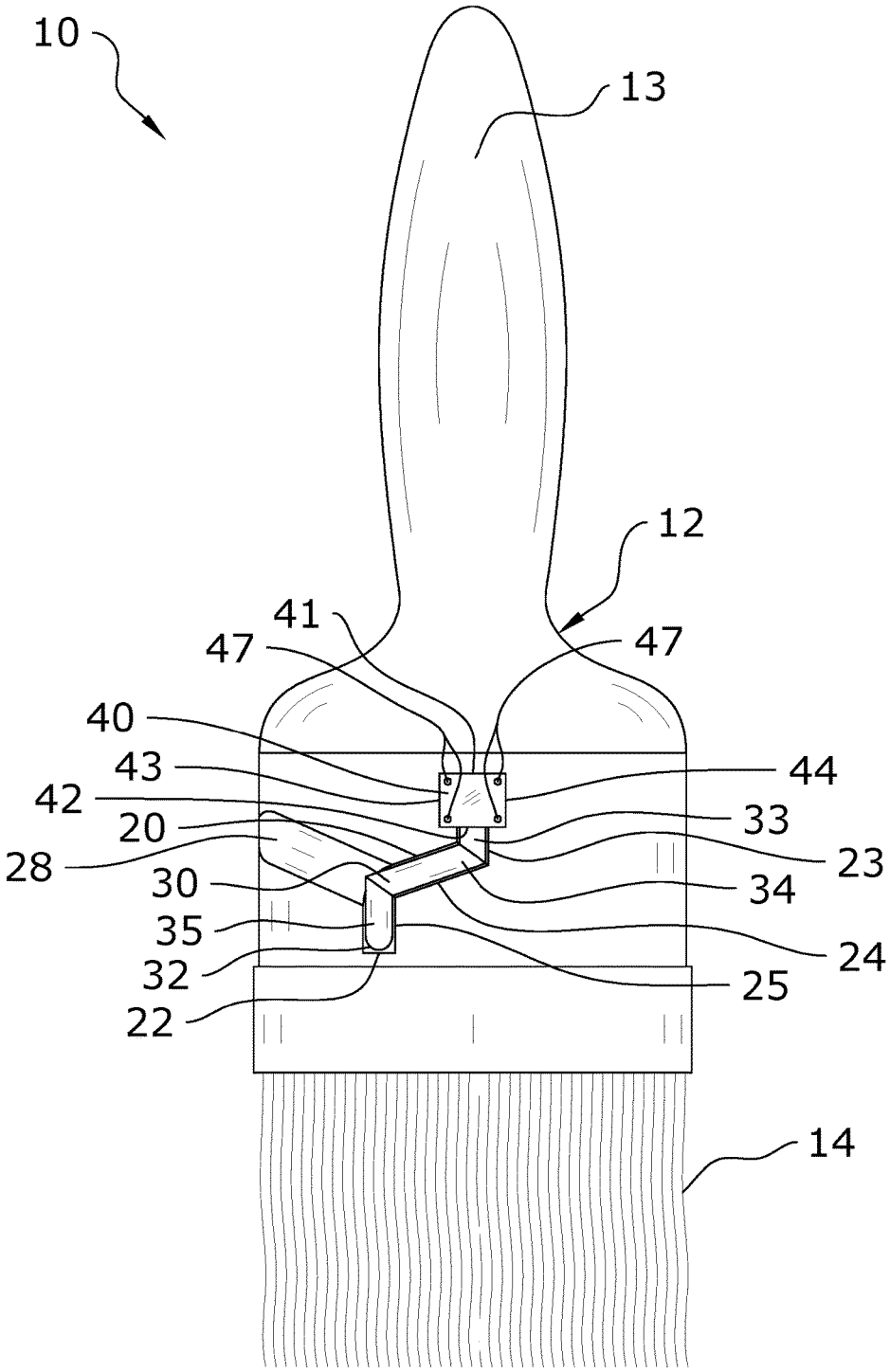
FIG. 6 is a frontal view of the present invention.

As best shown in FIG. 5, the present invention generally includes a groove 20 which is formed within the body 13 of the brush 12, such as in the handle. The shape, size, placement, and configuration of the groove 20 may vary in different embodiments. In a preferred embodiment as shown in the figures, the groove 20 comprises a first end 21 and a second end 22 and is adapted to retain a hanger rod 30 therein.

Figure 7:
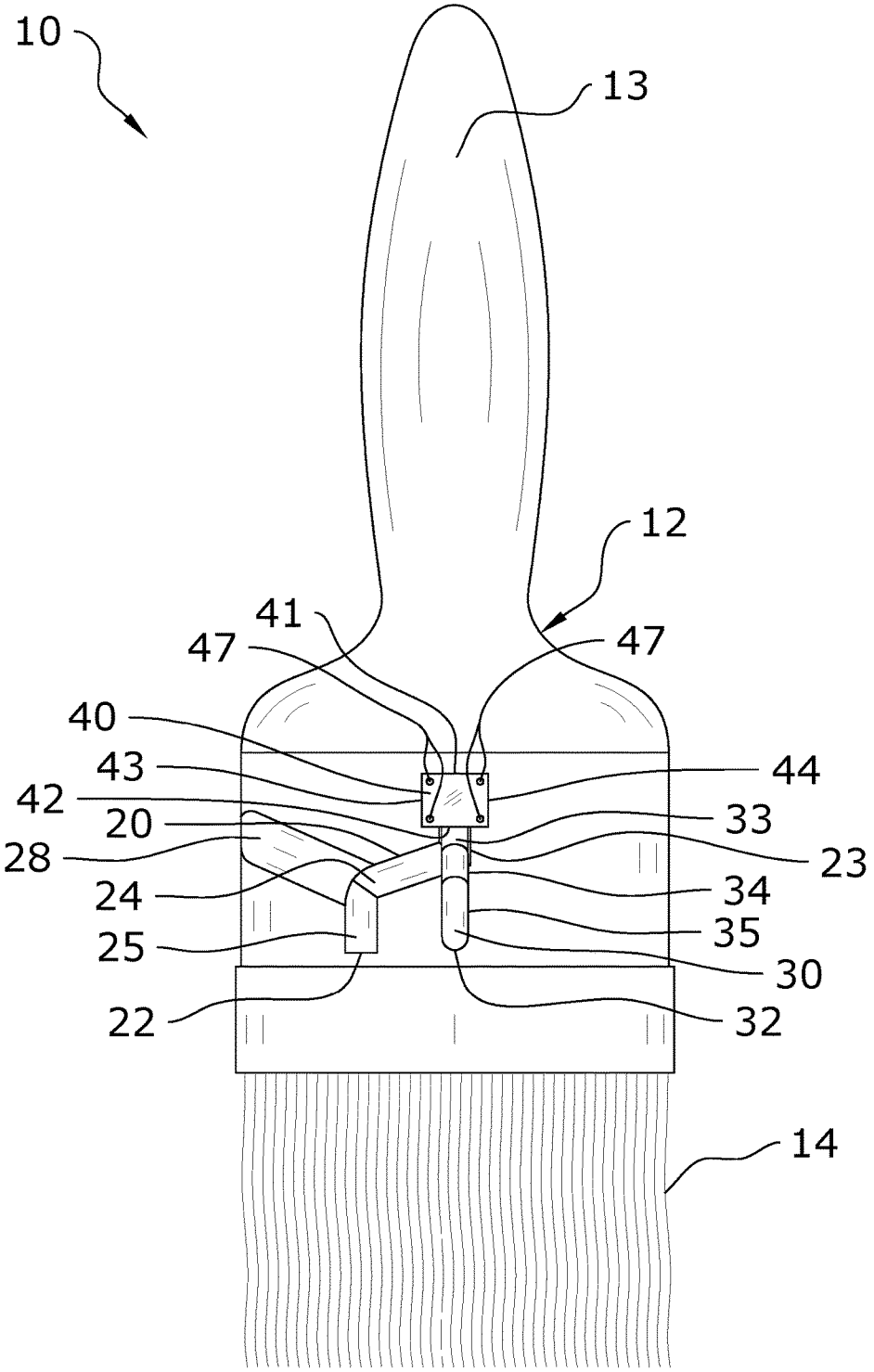
FIG. 7 is a frontal perspective view of the present invention with the hanger in an extended position.
Figure 8:
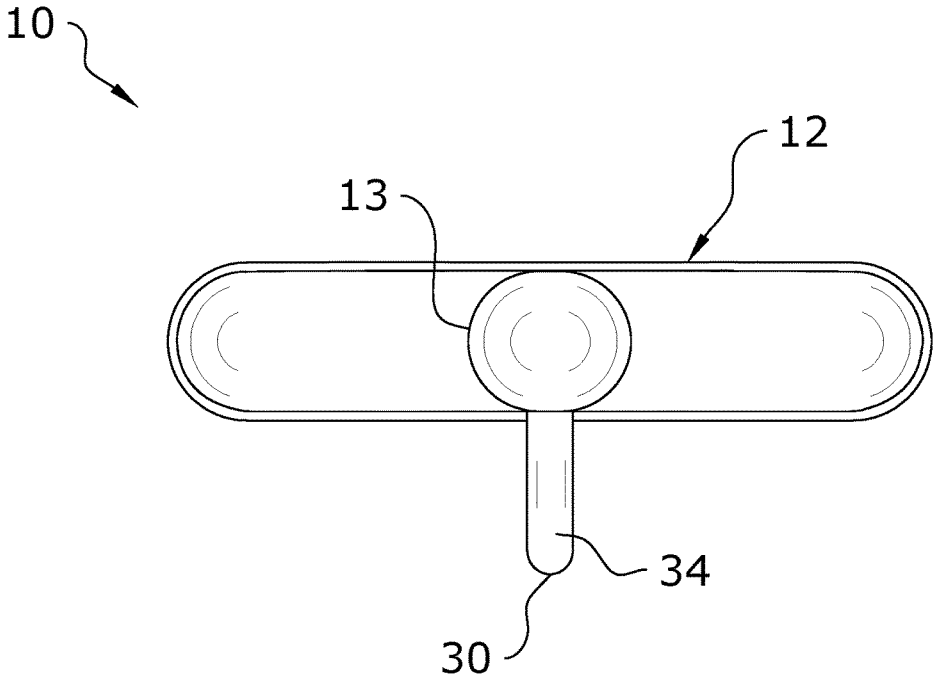
FIG. 8 is a bottom view of the present invention.
Figure 9:
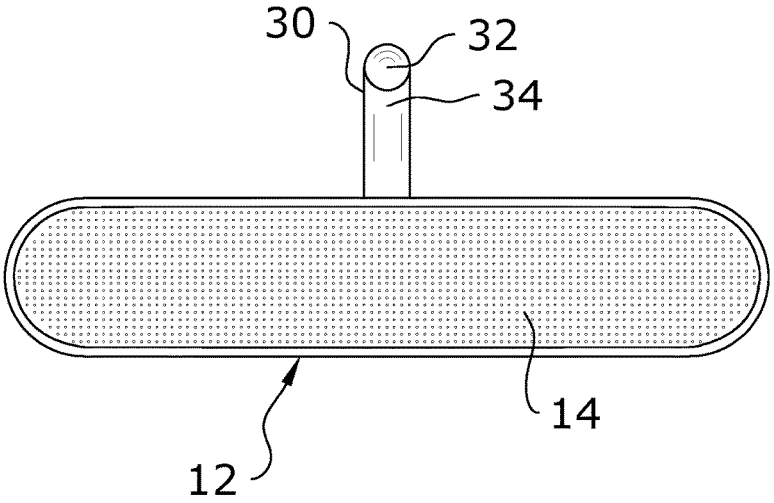
FIG. 9 is a top view of the present invention.

The overall shape of a preferred embodiment of the groove 20 is shown in FIG. 7. As shown, the groove 20 will generally comprise a first segment 23, a second segment 24, and a third segment 25; with each of the groove segments 23, 24, 25 being adapted to receive and retain a corresponding segment 33, 34, 35 of the hanger rod 30.

As shown in the figures, the second groove segment 24 extends at a first angle with respect to the first groove segment 23 and the third groove segment 25 extends at a second angle with respect to the second groove segment 24. In some embodiments, the first and second angles may be equal to each other. In a preferred embodiment, the first and second angles each are equal to ninety degrees (right angles). In other embodiments, however, the first and second angles may be different from each other.

As shown throughout the figures, the present invention may also utilize a notch 28 which provides access to the groove 20. The notch 28 eases grasping of the hanger rod 30 by a user of the present invention. The positioning, shape, size, orientation, and configuration of the notch 28 may vary in different embodiments of the present invention. The notch 28 should not be construed as limited by the exemplary figures.

D. Hanger Rod

Figure 2:
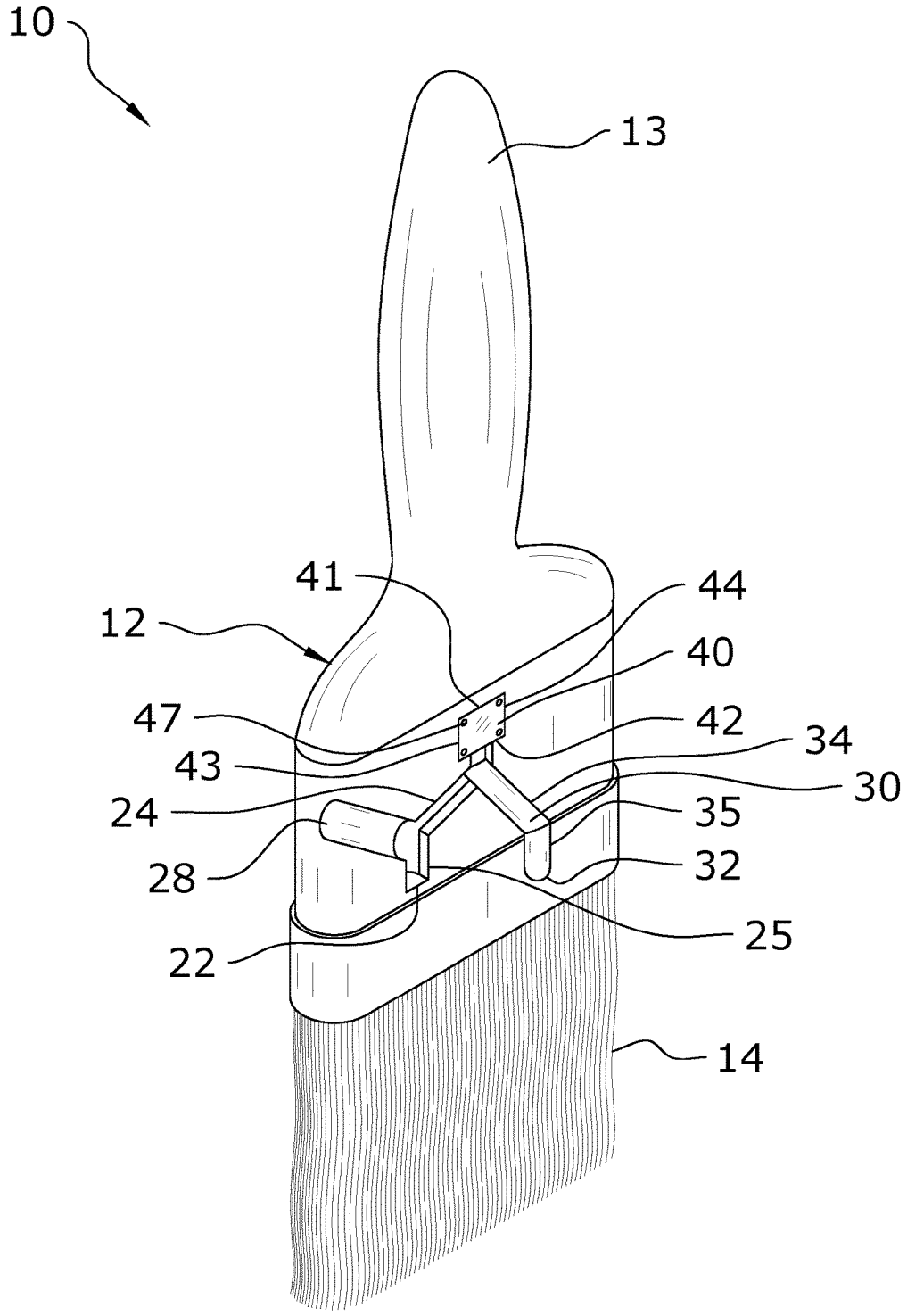
FIG. 2 is an upper perspective view of the present invention with the hanger in an extended position.

The present invention utilizes a pivotable hanger rod 30 which is positioned within the groove 20. The hanger rod 30 is adapted to be secured with an object 16 such as a paint can by engaging the hanger rod 30 with the rim 17 of the object 16. As shown throughout the figures, the hanger rod 30 generally comprises an elongated member, such as a rod, which includes a first end 31 and a second end 32. The hanger rod 30 is generally pivotable about a vertical axis at its first end 31 as shown in FIGS. 1 and 2.

As best shown in FIG. 5, the hanger rod 30 comprises a first segment 33, a second segment 34, and a third segment 35. These rod segments 33, 34, 35 fit within the corresponding segments 23, 24, 25 of the groove 20. Preferably, the hanger rod 30 is completely positioned within the groove 20 in a flush or recessed configuration as shown in FIG. 1. This ensures that the hanger rod 30 does not abut out or act as an obstruction except when it is fully extracted out of the groove 20.

As shown in the figures, the second rod segment 34 extends at a first angle with respect to the first rod segment 33 and the third rod segment 35 extends at a second angle with respect to the second rod segment 34. In some embodiments, the first and second angles may be equal to each other. In a preferred embodiment, the first and second angles each are equal to ninety degrees (right angles). In other embodiments, however, the first and second angles may be different from each other. Preferably, the angles of the rod segments 33, 34, 35 will be the same as the angles of the groove segments 23, 24, 25.

Figure 4:
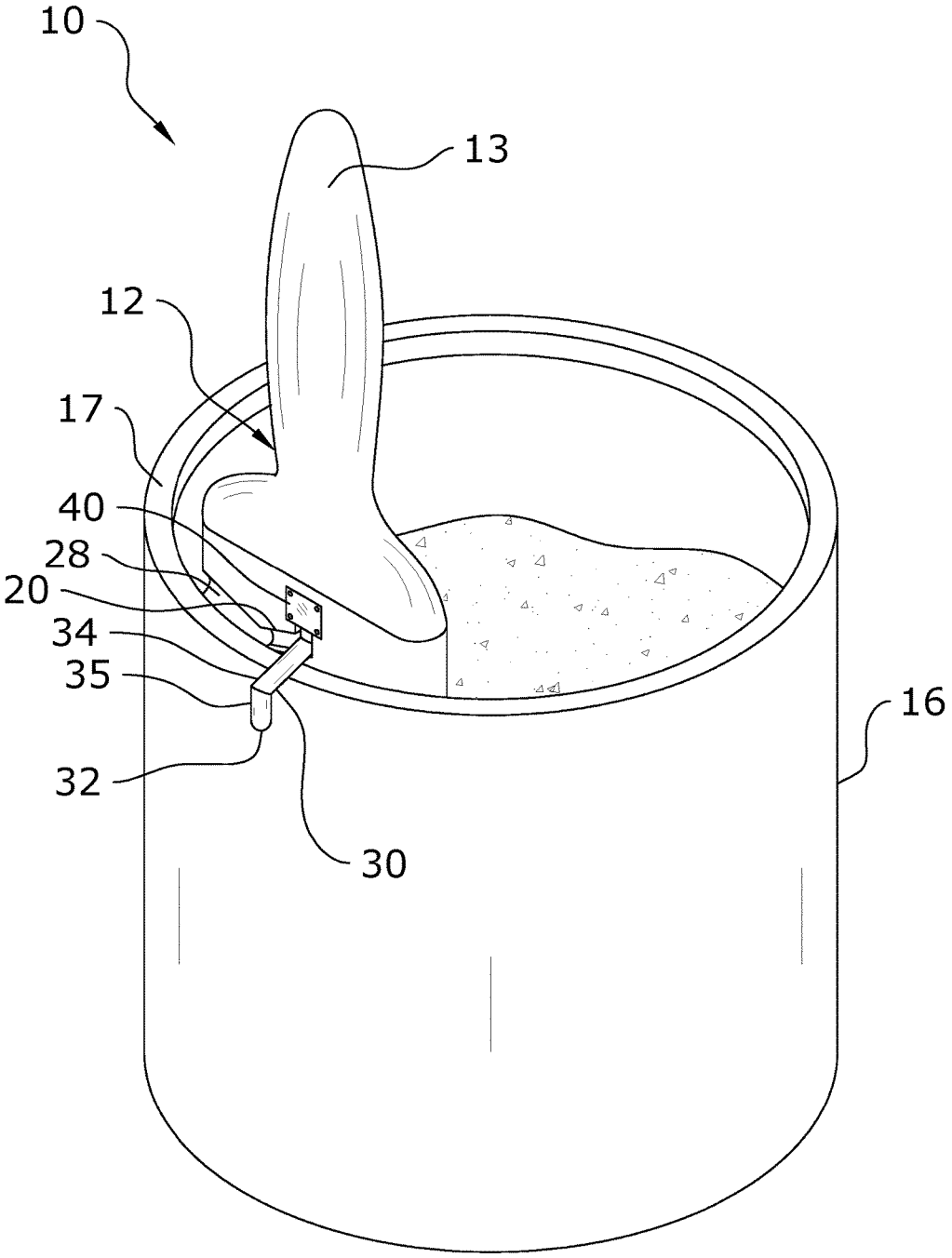
FIG. 4 is an upper perspective view of the present invention being used to secure a paint brush to a paint can.

As shown in the figures, the hanger rod 30 pivots about its first segment 33, with the second and third segments 34, 35 of the hanger rod 30 pivoting out of and back into the groove 20 when in use. When extended, the second and third segments 34, 35 of the hanger rod 30 extend outwardly to removably engage with an object 16 such as using its rim 17 as shown in FIG. 4. When retracted, the second and third segments 34, 35 of the hanger rod 30 are stored completely in the groove 20 such that no portion of the hanger rod 20 extends or abuts out of the groove 20.

E. Plate

As shown throughout the figures, the present invention will generally include a plate 40 that is secured over the first segment 23 of the groove 20 such that the first segment 33 of the hanger rod 30 is pivotally secured within the groove 20. The plate 40 may be fixedly secured to the brush 12, such as by welding, or may be removably secured to the brush 12, such as by pins 47 as shown in the figures.

Generally, the plate 40 will comprise a flat member having an upper end 41, a lower end 42, a first side 43, a second side 44, and outer surface 45 and an inner surface 46. The outer surface 45 faces away from the groove 20 and the inner surface 46 faces toward the groove 20.

Preferably, the outer surface 45 of the plate 40 will be connected to the brush 12 in a flush configuration as shown in FIG. 2. In some embodiments, the plate 40 may be recessed with respect to the brush 12. These configurations ensure that the plate 40 does not interfere with normal operation of the brush 12 when in use.

As shown in FIG. 5, to allow the plate 40 to be flush or recessed with the brush 12, a recessed portion 29 may be formed in the body 13 of the brush 12. The recessed portion 29 will generally be formed to surround the first segment 23 of the groove 20 as shown in the figures. Preferably, the recessed portion 29 will match closely the outer shape of the plate 40 to allow for a tight fit. The recessed portion 29 will also preferably be the same height as the first segment 23 of the groove 20. The width of the recessed portion 29 in some embodiments may be greater than the width of the first segment 23 of the groove 20. The recessed portion 29 may include apertures 27 as shown in FIG. 5.

The upper end 41 of the plate 40 will be secured at or near the first end 21 of the groove 20, with the plate 40 entirely covering the first segment 23 of the groove 20 and the first segment 33 of the hanger rod 30. The remaining segments (second and third segment) 34, 35 of the hanger rod 30 will freely pivot extend or retract the hanger rod 30 with respect to the groove 20.

F. Operation of Preferred Embodiment

In use, the brush 12 may be utilized as is common in the art. The brush 12 is generally dipped into the can 16 to apply paint or another substance to the bristles 14. The brush 12 may then be utilized to apply the substance to a surface, such as by passing the bristles 14 over that surface.

At some point, it will become necessary to place the brush 12 down for a short or extended period of time. For example, after applying a first coat of paint, it may be desirable to apply a second coat of a different type of paint. In that case, the brush 12 will be put down to access another paint can 16. Alternatively, if the phone rings or some other distraction occurs, it will be necessary to temporarily put down the brush 12. In either of these cases, it can be extremely messy if one is forced to just place the brush 12 down on any surface. It would be much more preferable to secure the brush 12 against another object 16 to prevent such a mess.

FIG. 1 illustrates the hanger rod 30 in its retracted position. Notably, the hanger rod 30 is completely positioned within the groove 20 such that no portion of the hanger rod 30 extends out from the body 13 of the brush 12. This ensures that the hanger rod 30 does not get in the way of normal usage.

Figure 3:
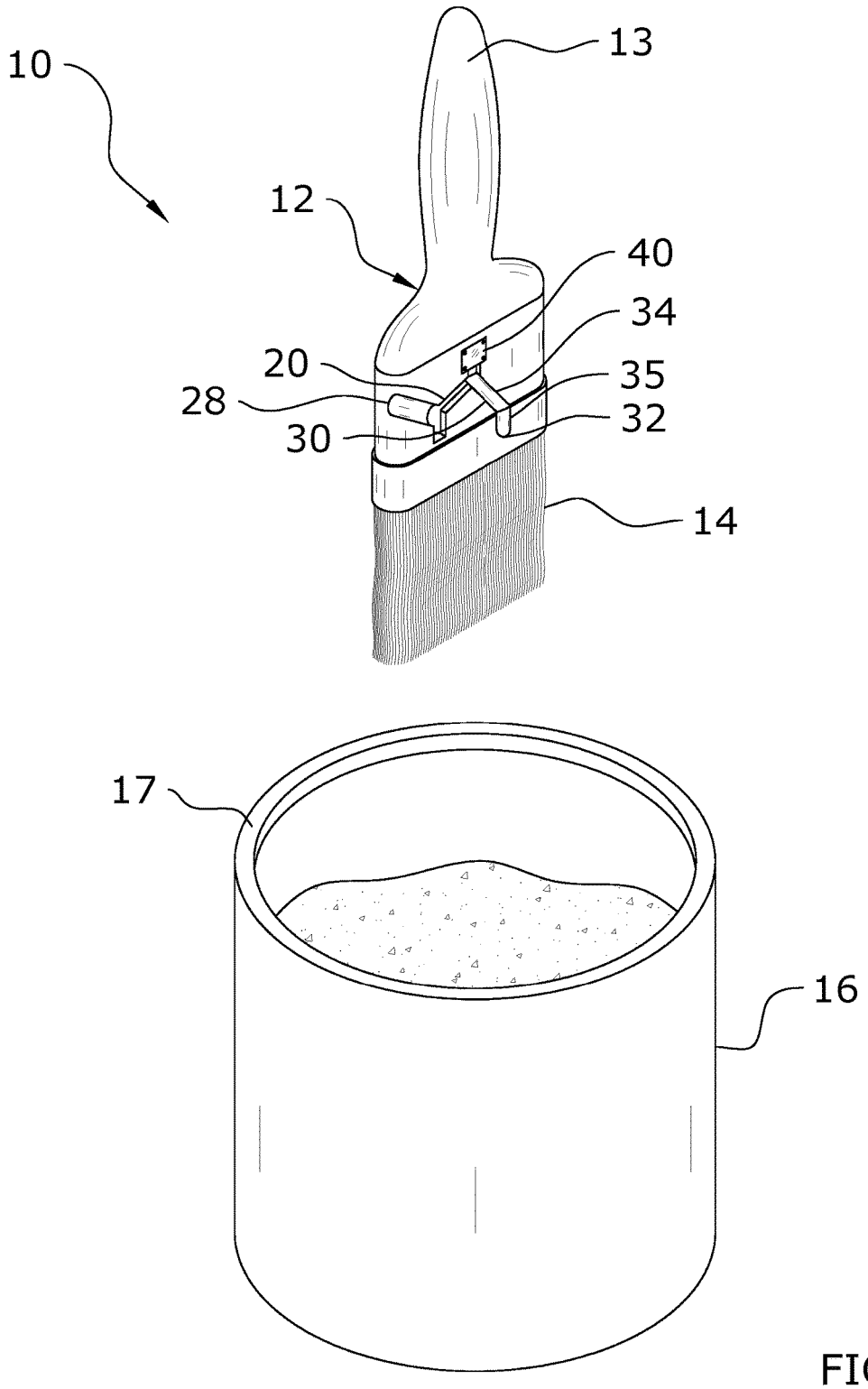
FIG. 3 is an upper perspective view of the present invention positioned over a paint can.

To secure the brush 12 against the object 16, the hanger rod 30 is first extended out of the groove 20 as shown in FIG. 2. Generally, the second end 32 of the hanger rod 30 is grasped by a finger or a tool and pulled outwardly from the groove 20. The notch 28 may be utilized to provide ease-of-access to the hanger rod 30. The hanger rod 30 will thus pivot about its first end 31, which is retained in place by the plate 40. The second and third segments 34, 35 of the hanger rod 30 will thus extend outwardly as shown in FIGS. 2 and 3.

Figure 10:
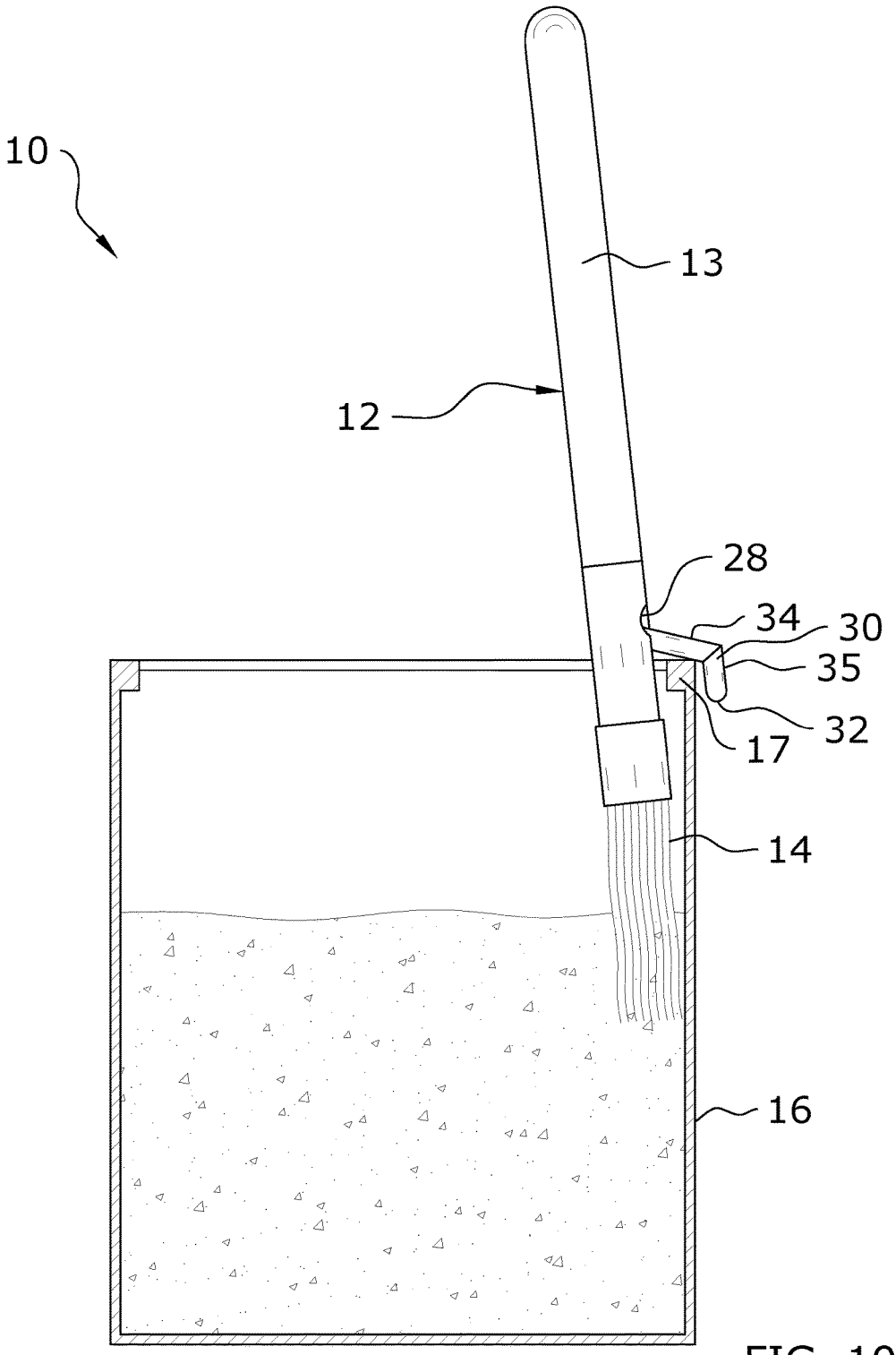
FIG. 10 is a sectional view of the present invention in use.

With the hanger rod 30 extended, the brush 12 may be secured against the object 16. The brush 12 is lowered onto the object 16 with the hanger rod 30 extending outwardly as shown in FIG. 3. The brush 12 may be secured against the object 16 by resting the second segment 34 of the hanger rod 30 against the rim 17 of the object 16. As shown in FIGS. 4 and 10, the second segment 34 will extend across the rim 17, with the third segment 35 extending downwardly from a distal end of the second segment 34 to prevent the brush 12 from falling into the object 16. Any paint or other substance falling from the bristles 14 will fall into the object 16 itself, thus preventing any contamination or spilling.

When desired, the brush 12 may be retrieved from the object 16 for further use or for storage. The brush 12 is lifted up and away from the object 16 such that the hanger rod 30 disengages with its rim 17. The hanger rod 30 may then be retracted into its nested position within the groove 20 by pushing the hanger rod 30 back toward the brush 12. The hanger rod 30 will pivot about its first end 31 until the hanger rod 30 is completely positioned within the groove 20.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A brush hanging system, comprising:

a brush;

a groove formed within a body of the brush, wherein the groove comprises a first groove segment, a second groove segment, and a third groove segment;

a plate that pivotally secures the first rod segment within the first groove segment; and a hanger rod pivotally connected within the groove, wherein the hanger rod comprises a first rod segment, a second rod segment, and a third rod segment, the hanger rod being adapted to selectively engage or disengage with an object to removably secure the brush to the object.

2. The brush hanging system of claim 1, wherein the first rod segment fits within the first groove segment, the second rod segment fits within the second groove segment, and the third rod segment fits within the third groove segment.

3. The brush hanging system of claim 1, wherein the first groove segment extends at a first angle with respect to the second groove segment and wherein the second groove segment extends at a second angle with respect to the third groove segment.

4. The brush hanging system of claim 3, wherein the first angle and the second angle each comprise a 90 degree angle.

5. The brush hanging system of claim 3, wherein the first rod segment extends at the first angle with respect to the second rod segment and wherein the second rod segment extends at the second angle with respect to the third rod segment.

6. The brush hanging system of claim 5, wherein the first angle and the second angle each comprise a 90 degree angle.

7. The brush hanging system of claim 1, wherein the hanger rod is adapted to be completely positioned within the groove.

8. A brush hanging system, comprising:

an object including a rim;

a brush;

a groove formed within a body of the brush, wherein the groove comprises a first groove segment, a second groove segment, and a third groove segment;

a hanger rod pivotally connected within the groove, wherein the hanger rod comprises a first rod segment, a second rod segment, and a third rod segment; and a plate connected over the first rod segment and the first groove segment such that the first rod segment pivots within the first groove segment;

wherein the hanger rod is adapted to removably connect to the rim for removably securing the brush to the object.

9. The brush hanging system of claim 8, wherein the brush comprises a paint brush.

10. The brush hanging system of claim 8, wherein the object comprises a paint can.

11. A brush hanging system, comprising:

an paint can;

a paint brush;

a groove formed within a body of the paint brush, the groove comprising a first groove segment, a second groove segment extending from the first segment at a 90 degree angle, and a third groove segment extending from the second groove segment at a 90 degree angle; and a hanger rod pivotally connected within the groove, the hanger rod comprising a first rod segment, a second rod segment extending from the first rod segment at a 90 degree angle, and a third rod segment extending from the second rod segment at a 90 degree angle; and a plate connected over the first rod segment and the first groove segment such that the second and third rod segments are adapted to pivot into or out of the groove.

12. The brush hanging system of claim 11, wherein the paint can includes a rim, wherein the second and third rod segments are adapted to removably engage with the rim.

13. The brush hanging system of claim 11, wherein the plate is flush with respect to the body of the brush.

14. The brush hanging system of claim 11, wherein the hanger rod is adapted to be completely positioned within the groove in a flush manner.

15. A brush hanging system, comprising:

a brush;

a groove formed within a body of the brush, wherein the groove comprises a first groove segment, a second groove segment, and a third groove segment, wherein the first groove segment extends at a first angle with respect to the second groove segment and wherein the second groove segment extends at a second angle with respect to the third groove segment, wherein the first angle and the second angle each comprise a 90 degree angle; and a hanger rod pivotally connected within the groove, the hanger rod being adapted to selectively engage or disengage with an object to removably secure the brush to the object.

* * * * *